US007022447B2

(12) United States Patent
Miyakawa

(10) Patent No.: US 7,022,447 B2
(45) Date of Patent: Apr. 4, 2006

(54) TONER AND IMAGE FORMING APPARATUS USING THE SAME

(75) Inventor: Nobuhiro Miyakawa, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 146 days.

(21) Appl. No.: 10/651,022

(22) Filed: Aug. 29, 2003

(65) Prior Publication Data

US 2004/0096765 A1 May 20, 2004

(30) Foreign Application Priority Data

Aug. 30, 2002 (JP) ..... 2002-252680

(51) Int. Cl.
*G03G 9/08* (2006.01)

(52) U.S. Cl. ..... 430/108.6; 430/108.7

(58) Field of Classification Search ..... 430/108.6, 430/108.7
See application file for complete search history.

(56) References Cited

U.S. PATENT DOCUMENTS 6,190,814 B1 * 2/2001 Law et al. ..... 430/108.7
6,819,899 B1 * 11/2004 Miyakawa et al. ..... 399/252

FOREIGN PATENT DOCUMENTS

JP 2002-029730 A 1/2002
JP 2002-148848 A 5/2002

* cited by examiner

*Primary Examiner*—John L Goodrow
(74) *Attorney, Agent, or Firm*—Sughrue Mion, PLLC

(57) ABSTRACT

The present invention provides a toner which ensures large mean charging amount and excellent transfer efficiency with no or little amount of reversely charged toner and provides an image forming apparatus using the same. The toner is produced by adding external additives to resin particles containing a coloring agent, wherein the external additives are silica particles and modified silica particles of which outer surfaces are modified with oxide or hydroxide of at least one metal selected from a group consisting of titanium, tin, zirconium, and aluminum, the amount of the modified silica particles being 1.5 times or less of the amount the silica particles. The image forming apparatus uses the toner.

12 Claims, 3 Drawing Sheets

TONER AND IMAGE FORMING APPARATUS USING THE SAME

BACKGROUND OF THE INVENTION

The present invention relates to a toner, to be used for electrophotograph or electrostatic printing. More particularly, the present invention is directed to provide a toner which is capable of exhibiting high transfer efficiency without fog and which comprises toner particles, containing a coloring agent, and external additives, and to provide an image forming apparatus using the same.

In the electrophotographic technology, after an electrostatic latent image formed on a photoreceptor having a photoconductive material is developed with toner particles, the toner image is fixed to a transfer medium such as a paper sheet with heat, pressure, and the like, thereby forming a copy or a printed matter.

It is a general way to add external additives to a toner in order to improve the properties of the toner. As the external additives, silicon dioxide, aluminum oxide, titanium oxide and the like are generally employed alone or in combination. In this case, in order to utilize the characteristics of the respective external additives, the combination use is common rather than the single use.

However, the characteristics of the toner depend on the properties of the toner particles such as the particle size and are therefore instable. For example, there is a distribution in charging amount so that a negatively charged toner inevitably includes positively charged toner particles.

In an image forming apparatus forming an image by means of negative charge reversal development, this leads a problem of increasing the fog because such toner particles adhere to non-image portions of the photoreceptor on which an electrostatic latent image is formed. Particularly, as the number of image formation increases, the toner contains particles of which original characteristics change. As a result, the amount of toner to be fog toner increases.

It is considered that a large amount of silica is added in order to maintain the characteristics of the toner to maintain the fluidity of the toner. Though the fluidity of the toner is improved, the fixing property of the toner is reduced.

Further, titania having positively chargeable property opposite to the polarity of the toner is added with silica to the toner in order to improve the negatively chargeable capacity of the toner, thereby improving the early rising property of negative charging of the toner. As the number of printed sheets increases, titania particles may be liberated from the surfaces of toner particles. To prevent the liberation of titania particles, the inventors of this invention have proposed a method of externally adding titania, of which work function is large, after externally adding silica, of which work function is small, to toner mother particles. In this method, the amount of silica to be added should be increased to correspond to the increase in amount of titania in order to compensate the amount of titania to be liberated from the surfaces of toner particles. However, as the amount of silica is increased, the fixing property of toner has a tendency to relatively decrease.

When the negatively chargeable property of the toner becomes too high, the density of printed images should be low. To prevent this, it is known to use titanium having relatively large primary particle diameter and relatively low electrical resistance in order to prevent the titania particles from being embedded into toner particles. However, as the number of image forming sheets increases, the liberation from the surfaces of toner mother particles may be caused, it is hardly exhibit the effects well.

Disclosed in JP (A) 2002-29730 is an electrophotographic toner in which fine silica particles are coated with hydroxide or oxide of one or more of titanium, tin, zirconium, and aluminum in a water system and further coated with alkoxysilane so as to prepare hydrophobic fine particles and the hydrophobic fine particles thus prepared are used as an external additive. Disclosed in JP(A) 2002-148848 is a toner in which silica particles are coated with titanium oxide so as to prepare titanium oxide particles containing silica and the titanium oxide particles thus prepared are used as an external additive. Though the addition of a predetermined amount of such an external additive can reduce the amount of positively charged toner particles, enough average charging amount can not obtained. Therefore, neither of these can satisfy both objects of improving the transfer efficiency and reducing the amount of reversely transferred toner particles.

It is an object of the present invention to provide a toner with which high transfer efficiency can be obtained with no or little fog at non-image portion.

SUMMARY OF THE INVENTION

Figure 1:
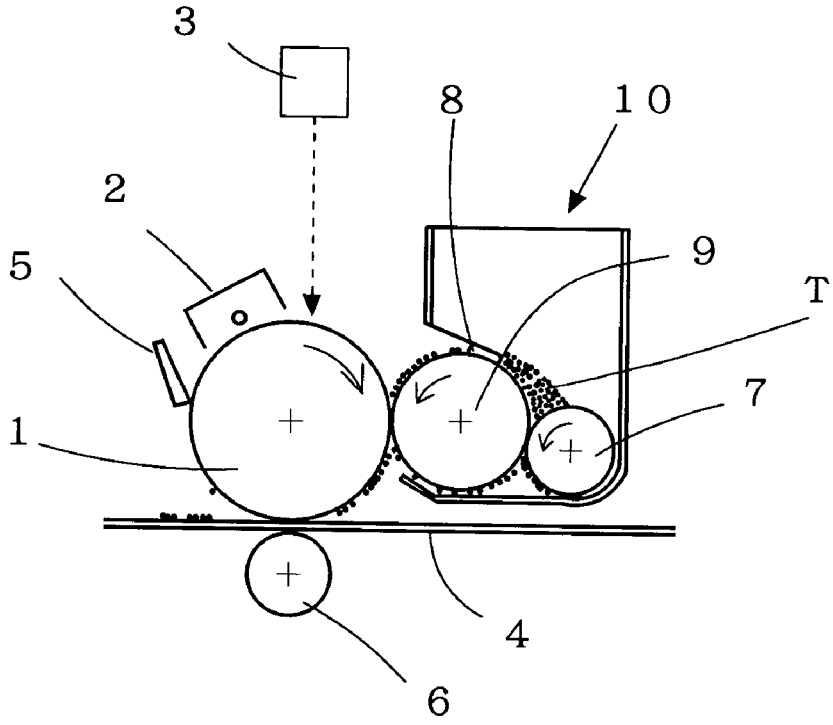
FIG. 1 is an illustration for explaining a contact developing process in an image forming apparatus using a toner of the present invention.

A toner of the present invention is a toner produced by adding external additives to resin particles containing a coloring agent, wherein the external additives are silica particles and modified silica particles of which outer surfaces are modified with oxide or hydroxide of at least one metal selected from a group consisting of titanium, tin, zirconium, and aluminum, and wherein the ratio of the modified silica particles relative to the silica particles is 1.5 or less by weight.

The toner as mentioned above is characterized in that as the silica particles, two kinds of silica particles having different number-mean primary particle diameter are dispensed.

The toner as mentioned above is characterized in that the number-mean primary particle diameter of the silica particles of one kind is in a range from 5 to 20 nm and the number-mean primary particle diameter of the silica particles of the other kind is in a range from 30 to 50 nm.

The toner as mentioned above is characterized in that the number-mean primary particle diameter of the silica particles of one kind is in a range from 7 to 16 nm and the number-mean primary particle diameter of the silica particles of the other kind is in a range from 30 to 40 nm.

The toner as mentioned above is characterized by being produced in the polymerization method.

The toner as mentioned above is characterized in that the degree of circularity of the toner particles is 0.94 or more.

The toner as mentioned above is characterized in that the number-mean particle diameter of the toner particles is 9 μm or less.

An image forming apparatus of the present invention is a full color image forming apparatus having an intermediate transfer medium for transferring an image formed on a photoreceptor onto a recording medium and of which toners are each produced by adding external additives to resin particles, wherein the external additives are silica particles and modified silica particles of which outer surfaces are modified with oxide or hydroxide of at least one metal selected from a group consisting of titanium, tin, zirconium, and aluminum, and wherein the ratio of the modified silica particles relative to the silica particles is 1.5 or less by weight.

The image forming apparatus as mentioned above is characterized in that as the silica particles, two kinds of silica particles having different number-mean primary particle diameter are dispersed.

The image forming apparatus as mentioned above is characterized in that the toners are negatively chargeable toners and the photoreceptor is a negatively chargeable organic photoreceptor.

The image forming apparatus as mentioned above is characterized in that the intermediate transfer medium comprises a belt.

The image forming apparatus as mentioned above is characterized in that the photoreceptor and the developing devices are combined in one unit as a process cartridge which is detachably installed to the body of the image forming apparatus.

The image forming apparatus as mentioned above is characterized in that the peripheral velocity difference between the photoreceptor and the intermediate transfer medium is set to be in a range from 0.95 to 1.05.

DESCRIPTION OF THE PREFERRED EMBODIMENTS

The present invention is based on a discovery of the following. In a toner produced by adding external additives to resin particles containing a coloring agent, the external additives are silica particles and modified silica particles of which surfaces are modified with oxide or hydroxide of at least one metal selected from a group consisting of titanium, tin, zirconium, and aluminum such that the modified silica particles becomes a predetermined amount relative to the silica particles, whereby the charging property of the toner is improved, the amount of reversely charged toner particles is reduced so that both the stability of charging property of the toner and the improvement of transfer efficiency of the toner are achieved.

Since the toner of the present invention uses silica particles of which surfaces are modified with hydroxide or oxide of at least one of titanium, tin, zirconium, and aluminum and are subjected to hydrophobic treatment, the toner has a negative frictional charge site according to the silica components and a relatively positive frictional charge site. The silica components as particle substrate adhere to the surfaces of toner particles. As a result, the rate of liberation of external additives due to successive printing is reduced so that stable charging property can be ensured for a long period of time.

By using the aforementioned modified silica particles in an amount corresponding to 1.5 times or less of the amount of silica particles, the negative excessive charging can be prevented, enabling the stable image formation.

As the ratio of the modified silica fine particles relative to the total amount of silica particles having a small number-mean primary particle diameter and silica particles having a large number-mean primary particle diameter exceeds 1:1, the negatively charging amount is reduced. Accordingly, by adding these silica particles together, the negative excessive charging can be prevented and the generation of positively charged toner i.e. toner having reverse polarity can be prevented. As a result, the toner enables the stable image formation without occurrence of fog and toner scattering.

Since the external additive of the present invention can exhibit desired function of the external additive even if the external additive is added in small amounts, reduction in amount of used external additive is achieved so that the fixing property of the toner is prevented from being deteriorated.

The reduction in amount is achieved in case where the modified silica particles are used as the external additive together with silica in a toner produced in the polymerizing method, compared to the case where titania and alumina are used. Therefore, the deterioration of fixing property is prevented.

Whether the toner is prepared by the pulverization method or the polymerization method, it is necessary to increase the additive amount of silica as the particle size of toner particles is small. Therefore, the initial charging amount of the toner is too large. As the number of printing increases, the effective surface areas of the external additives are reduced due to embedded particles into toner mother particles and scattered particles so that the charging amount of the toner is reduced. As a result, there is a tendency to increase variation in image density and the amount of fog toner so as to increase the consumption of the toner. That is, the toner is unfavorable as a developer. Because of the aforementioned synergistic effects, however, the toner can be used as a stable negatively chargeable toner.

The toner mother particles used in the manufacturing of the toner of the present invention may be prepared by the pulverization method or the polymerization method. However, the polymerization method is preferable for full color toner.

For preparing a toner using the pulverization method, a release agent and a charge control agent are uniformly mixed with a resin binder containing at least a pigment by a Henschel mixer, melt and kneaded by a twin-shaft extruder. After cooling process, they are classified through the rough pulverizing-fine pulverizing process. Further, external additives are added.

As the binder resin, a known synthetic resin for toner maybe used. Preferable examples are homopolymers or copolymers containing styrene or styrene substitute, such as polystyrene, poly-α-methyl styrene, chloropolystyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate ester copolymers, styrene-methacrylate ester copolymers, styrene-acrylate ester-methacrylate ester copolymers, styrene-α-chloracrylic methyl copolymers, styrene-acrylonitrile-acrylate ester copolymers, and styrene-vinyl methyl ether copolymers; polyester resins, epoxy resins, polyurethane modified epoxy resins, silicone modified epoxy resin, vinyl chloride resins, rosin modified maleic acid resins, phenyl resins, polyethylene, polypropylene, ionomer resins, polyurethane resins, silicone resins, ketone resins, ethylene-ethylacrylate copolymers, xylene resins, polyvinyl butyral resins, terpene resins, phenolic resins, and aliphatic or alicyclic hydrocarbon resins. These resins may be used alone or in blended state.

In the present invention, styrene-acrylate ester-based resins, styrene-methacrylate ester-based resins, and polyester resins are especially preferable. The binder resin preferably has a glass-transition temperature in a range from 50 to 75° C. and a flow softening temperature in a range from 100 to 150° C.

As the coloring agent, a known coloring agent for toner may be used. Examples are Carbon Black, Lamp Black, Magnetite, Titan Black, Chrome Yellow, Ultramarine Blue, Aniline Blue, Phthalocyanine Blue, Phthalocyanine Green, Hansa Yellow G, Rhodamine 6G, Chalcone Oil Blue, Quinacridon, Benzidine Yellow, Rose Bengal, Malachite Green lake, Quinoline Yellow, C.I. Pigment red 48:1, C.I. Pigment red 122, C.I. Pigment red 57:1, C.I. Pigment red 184, C.I. Pigment yellow 12, C.I. Pigment yellow 17, C.I. Pigment yellow 97, C.I. Pigment yellow 180, C.I. Solvent yellow 162, C.I. Pigment blue 5:1, and C.I. Pigment blue 15:3. These dyes and pigments can be used alone or in blended state.

As the release agent, a known release agent for toner may be used. Specific examples are paraffin wax, micro wax, microcrystalline wax, candelilla wax, carnauba wax, rice wax, montan wax, polyethylene wax, polypropylene wax, oxygen convertible polyethylene wax, and oxygen convertible polypropylene wax. Among these, polyethylene wax, polypropylene wax, carnauba wax, or ester wax is preferably employed.

As the charge control agent, a known charge control agent for toner may be used. Specific examples are Oil Black, Oil Black BY, Bontron S-22 and Bontron S-34 (available from Orient Chemical Industries, LTD.); metal complex compounds of salicylic acid such as E-81 or E-84 (available from Orient Chemical Industries, LTD.), thioindigo type pigments, sulfonyl amine derivatives of copper phthalocyanine, Spilon Black TRH (available from Hodogaya Chemical Co., Ltd.), calix arene base compounds, organic boron compounds, quaternary ammonium salt compounds containing fluorine, metal complex compounds of monoazo, metal complex compounds of aromatic hydroxyl carboxylic acid, metal complex compounds of aromatic di-carboxylic acid, and polysaccharides. Among these, achromatic or white agents are especially preferable for unicolor toner.

Proportions in the toner prepared in the pulverization method are the coloring agent: 0.5–15 parts by weight, preferably 1–10 parts by weight, the release agent: 1–10 parts by weight, preferably 2.5–8 parts by weight, and the charge control agent: 0.1–7 parts by weight, preferably 0.5–5 parts by weight relative to 100 parts by weight of the binder resin.

In the toner prepared in the pulverization method according to the present invention, in order to improve the transfer efficiency, the toner is preferably spheroidized. For example, by using a turbo mill (available from Turbo Mill Industries, Ltd.) known as a machine allowing the toner to be pulverized into relatively spherical particles, the degree of circularity may be 0.93 maximum. Alternatively, by using a hot air spheroidizing apparatus (available from Nippon Pneumatic Mfg. Co., Ltd.) for treatment after pulverization, the degree of circularity may be 1.00 maximum.

It should be noted that the mean particle diameter and the degree of circularity of toner particles are values measured by a particle analyzer (FPIA2100 available from Sysmex corporation) in the present invention.

The polymerized toner may be prepared by the suspension polymerization method, the emulsion polymerization method, or the dispersion polymerization method. In the suspension polymerization, a monomer compound is prepared by melting or dispersing a polymerizable monomer, a coloring agent, a release agent, and, if necessary, a dye, a polymerization initiator, a cross-linking agent, a charge control agent, and other additive(s). By adding the monomer compound into an aqueous phase containing a suspension stabilizer (water soluble polymer, hardwater soluble inorganic material) with stirring, the monomer compound is granulated and polymerized, thereby forming unicolor toner particles having a desired particle size.

In the emulsion polymerization, a monomer, a release agent and, if necessary, a polymerization initiator, an emulsifier (surface active agent), and the like are dispersed into a water and are polymerized. During the coagulation, a coloring agent, a charge control agent, and a coagulant (electrolyte) are added, thereby forming unicolor toner particles having a desired particle size.

Among the materials for the polymerization method, the coloring agent, the release agent, and the charge control agent, may be the same materials for the toner prepared in the pulverization method.

As the polymerizable monomer, a known monomer of vinyl series maybe used. Examples include: styrene, o-methylstyrene, m-methylstyrene, p-methylstyrene, α-methylstyrene, P-methoxystyrene, p-ethylstyrene, vinyl toluene, 2,4-dimethylstyrene, p-n-butylstyrene, p-phenylstyrene, p-chlorostyrene, di-vinylbenzene, methyl acrylate, ethyl acrylate, propyl acrylate, n-butyl acrylate, isobutyl acrylate, n-octyl acrylate, dodecyl acrylate, hydroxyethyl acrylate, 2-ethyl hexyl acrylate, phenyl acrylate, stearyl acrylate, 2-chloroethyl acrylate, methyl methacrylate, ethyl methacrylate, propyl methacrylate, n-butyl methacrylate, isobutyl methacrylate, n-octyl methacrylate, dodecyl methacrylate, hydroxyethyl methacrylate, 2-ethyl hexyl methacrylate, stearyl methacrylate, phenyl methacrylate, acrylic acid, methacrylic acid, maleic acid, fumaric acid, cinnamic acid, ethylene glycol, propylene glycol, maleic anhydride, phthalicanhydride, ethylene, propylene, butylene, isobutylene, vinyl chloride, vinylidene chloride, vinyl bromide, vinyl fluoride, vinyl acetate, vinyl propylene, acrylonitrile, methacrylonitrile, vinyl methyl ether, vinyl ethyl ether, vinyl ketone, vinyl hexyl ketone, and vinyl naphthalene. Examples of fluorine-containing monomers are 2,2,2-torifluoroethylacrylate, 2,2,3,3-tetrafluoropropylacrylate, vinyliden fluoride, ethylene trifluororide, ethylene tetrafluoride, and trifluoropropyrene. These are available because the fluorine atoms are effective for negative charge control.

Examples of the emulsifier (surface active agent) are dodecyl benzene sulfonic acid sodium, sodium-tetradecyl sulfate, pentadecyl sodium sulfate, sodium octylsulphate, sodium oleate, sodium laurate, potassium stearate, calcium oleate, dodecylammonium chloride, dodecylammonium bromide, dodecyltrimethylammonium bromide, dodecylpyridinium chloride, hexadecyltrimethylammonium bromide, dodecylpolyoxy ethylene ether, hexadecylpolyoxy ethylene ether, laurylpolyoxy ethylene ether, and sorbitan monooleate polyoxy ethylene ether.

Examples of the polymerization initiators include potassium persulfate, sodium persulfate, ammonium persulfate, hydrogen peroxide, 4,4'-azobis-cyano valeric acid, t-butyl hydro peroxide, benzoyl peroxide, and 2,2'-azobis-isobutyronitrile.

Examples of the coagulant (electrolyte) include sodium chloride, potassium chloride, lithium chloride, magnesium chloride, calcium chloride, sodium sulfate, potassium sulfate, lithium chloride, magnesium sulfate, calcium sulfate, zinc sulfate, aluminum sulfate, and iron sulfate.

Description will be made as regard to how to adjust the degree of circularity of the toner prepared by the polymerization. In the emulsion polymerization method, the degree of circularity can be freely changed by controlling the temperature and time in the coagulating process of secondary particles. The degree of circularity is in a range from 0.94 to 1.00. The suspension polymerization method enables to make perfect spherical toner particles. The degree of circularity is in a range from 0.98 to 1.00. By heating the toner particles at a temperature higher than the glass-transition temperature of toner to deform them for adjusting the circularity, the degree of circularity can be freely adjusted in a range from 0.94 to 0.98.

The number-mean particle diameter of the toner is preferably 9 μm or less, more preferably 8 μm to 4.5 μm. With a toner having a number-mean particle diameter greater than 9 μm, the reproducibility of resolution should be lowered as compared to a toner having small particle diameter when a latent image is formed with high resolution of 1200 dpi or more. As for a toner having a number-mean particle diameter of 4.5 μm or smaller, the contrast ratio of the toner is lowered and the increase in the amount of external additive is inevitable for improving the fluidity so that there is a tendency to deteriorate the fixing property. Therefore, these toners are unfavorable.

Now, description will be made as regard to the external additives. The toner particles of the present invention contain, as the external additives, silica particles and modified silica particles of which surfaces are modified with oxide or hydroxide of at least one metal selected from a group consisting of titanium, tin, zirconium, and aluminum. The modified silica particles are contained at 1.5 times or less by weight relative to the silica particles.

The silica particles may be dry-process particles made from silicon halide compound or wet-process particles deposited from silicon compound in liquid.

The mean particle diameter of primary particles of the silica particles is preferably from 7 nm to 40 nm, more preferably from 10 nm to 30 nm. Silica particles of which mean particle diameter of primary particles is less than 7 nm is easy to be embedded in toner mother particles and easy to be negatively charged. On the other hand, silica particles of which mean particle diameter of primary particles exceeds 40 nm have deteriorated effect of applying fluidity to toner mother particles, making the uniform negative charging of toner difficult. As a result, there is a tendency to increase the amount of toner particles which are reversely charged i.e. positively charged.

According to the present invention, it is preferable that silica particles having different number-mean particle diameter distributions are used and mixed. Inclusion of external additives having large particle diameter prevents the external additives from being embedded in the toner particles, while small-diameter silica particles provides the desirable fluidity.

Concretely, the number-mean primary particle diameter of unilateral silica is preferably from 5 nm to 20 nm, more preferably from 7 nm to 16 nm, while the mean primary particle diameter of the other silica is 30 nm to 50 nm, more preferably from 30 nm to 40 nm.

The particle diameters of the external additives are observed and measured by an image formed by an electron microscope. The number-mean particle diameter is defined as the mean particle diameter.

These silica particles used as external additives in the present invention are preferably processed by a hydrophobic treatment with a silane coupling agent, a titanium coupling agent, a higher fatty, silicone oil. Examples include dimethyldichlorosilane, octyl trimethylchlorosilane, hexamethyldisilane, silicone oil, octyl-trichlorosilane, decyl-trichlorosilane, nonyl-trichlorosilane, (4-iso-propylphenyl)-trichlorosilane, (4-t-buthylphenyl)-trichlorosilane, dipentyl-dichlorosilane, dihexyl-dichlorosilane, dioctyl-dichlorosilane, dinoyl-dichlorosilane, didecyl-dichlorosilane, didodecyl-dichlorosilane, (4-t-butylphenyl)-octyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, and (4-iso-prophylphenyl)-diethyl-chlorocilane.

The present invention is characterized in that the silica particles and modified silica particles of which surfaces are modified with a metal compound are used together such that the modified silica particles are used in a predetermined amount relative to the silica particles. The modified silica particles are silica particles having a specific surface area of 50–400 $m^2/g$ which are coated with hydroxide or oxide of at least one selected from a group consisting of titanium, tin, zirconium, and aluminum.

Par 100 parts by weight of silica particles, 1–30 parts by weight of the aforementioned hydroxide or oxide is used to coat and slurry the silica particles. Then, the solid matters in the slurry are coated with 3–50 parts by weight of alkoxysilane, after that, are neutralize by alkali, and are filtered, cleaned, dried, and pulverized, thereby obtaining the modified silica. The silica fine particles to be used to obtain the modified silica may be wet-process particles or vapor-phase-process particles.

The material for modifying the surfaces of the silica particles may be aqueous solution containing at least one of titanium, tin, zirconium, and aluminum. Examples include titanium sulfate, titanium tetrachloride, tin chloride, ferrous sulfate, zirconium oxychloride, zirconium sulfate, zirconium nitrate, aluminum sulfate, and sodium aluminate.

The surface modification of silica particles with the metal oxide or hydroxide is conducted by treating the slurry of the silica particles with aqueous solution of the metal compounds. The treatment temperature is preferably in a range from 20 to 90° C.

Then, the hydrophobic treatment is conducted by coating the silica with alkoxysilane. The hydrophobic treatment is conducted as follows. After adjusting the pH of the slurry to be 2–6 pH, preferably 3–6 pH, 30 to 50 parts by weight of at least one kind of alkoxysilane is added to 100 parts by weight of silica particles. The slurring temperature to 20–100° C., preferably 30–70° C., and the hydrolytic cleavage and condensation reaction are conducted, thereby achieving the hydrophobic treatment.

After adding the alkoxysilane, it is preferable to conduct the condensation reaction with adjusting the pH to 4–9 pH, preferably 5–7 pH, after stirring the slurry. For the adjustment of pH, sodium hydrate, potassium hydroxide, ammonia water, or ammonia gas may be employed. In this manner, stable fine particles which are uniformly hydrophobic-treated can be obtained.

After that, by filtering, washing, and drying the slurry, modified silica fine particles can be obtained.

The drying temperature is in a range from 100 to 190° C., preferably from 110 to 170° C. A temperature lower than 100° C. is unfavorable because it leads to poor drying efficiency and low hydrophobic degree. On the other hand, a temperature exceeding 190° C. is also unfavorable because it leads allochroism due to thermal decomposition of hydrocarbon radicals and leads to low hydrophobic degree.

The hydrophobic treatment may be conducted by coating the silica particles using a Henschel mixer after adding the alkosysilane to the modified silica particles.

According to the present invention, it is preferable that the amount of these external additives is 0.05 to 2 parts by weight per 100 parts by weight of toner mother particles.

The amount less than 0.05 parts by weight can not exhibit the effect of applying the fluidity and the effect of preventing the excess charging, while the amount exceeding 2 parts by weight lowers the charging amount of negative charge and increases the amount of positively charged toner i.e. reversely charged toner, thus increasing the amount of fog toner and the amount of reversely transferred toner.

FIG. 1 shows an example of a contact developing process in an image forming apparatus using a toner of the present invention. A photoreceptor 1 is a photosensitive drum which is 24–86 mm in diameter and rotates at a surface velocity of 60–300 mm/sec. After the surface of the photoreceptor 1 is uniformly negatively charged by a corona charging device 2, the photoreceptor 1 is exposed by an exposure device 3 according to information to be recorded. In this manner, an electrostatic latent image is formed.

A developing device 10 is a single-component developing device which supplies single-component non-magnetic toner T onto the organic photoreceptor to reversely develop the electrostatic latent image on the organic photoreceptor, thereby forming a visible image. The single-component non-magnetic toner T is housed in the developing means. The toner is supplied to the development roller 9 by a supply roller 7 which rotates in the counter-clockwise direction as shown in FIG. 1. The development roller 9 rotate in the counter-clockwise direction with holding the toner T, supplied by the supply roller 7, on the surface thereof so as to carry the toner T to contact portion with the organic photoreceptor, thereby making the electrostatic latent image on the organic photoreceptor 1 visible.

The development roller 9 maybe a roller made of a metallic pipe having a diameter 16–24 mm, of which surface is treated by plating or blasting or which is formed on its peripheral surface with a conductive elastic layer made of butadiene rubber, styrene-butadiene rubber, ethylene propylene rubber, polyurethane rubber, or silicone rubber to have a volume resistivity of $10^4$ to $10^8$ Ω cm and hardness of 40 to 70° (Asker A hardness). A developing bias voltage is applied to the development roller 9 via the shaft of the pipe from a power source (not shown). The entire developing device 10 composed of the development roller 9, the toner supply roller 7, and a toner regulating blade 8 may be biased against the organic photoreceptor by a biasing means such as a spring (not shown) with a pressure load of 19.6 to 98.1 N/m, preferably 24.5 to 68.6 N/m to have a nip width of 1 to 3 mm.

The regulating blade 8 is formed by pasting rubber tips on a stainless steel, a phosphor bronze, a rubber plate, or a metal sheet. The regulating blade is biased against the development roller by a biasing means such as a spring (not shown) or the bounce itself as an elastic member with a linear load of 245 to 490 mN/cm to make a toner layer on the development roller to have the number of stories made up of toner particles becomes 2 or more.

In the contact developing method, the dark potential of the photoreceptor is preferably set in a range from −500 V to −700 V, the light potential thereof is preferably set in a range from −50 V to −150 V, and the developing bias is preferably set in a range from −100 V to −400 V, but not shown. The development roller and the supply roller are preferably in the same potential.

In the contact developing method, the peripheral velocity of the development roller which rotates in the counter-clockwise direction is preferably set to have a ratio of peripheral velocity from 1.2 to 2.5, preferably 1.5 to 2.2 relative to that of the organic photoreceptor which rotates in the clockwise direction. Therefore, even small-diameter toner particles are reliably subjected to the contact triboelectric charging with the organic photoreceptor.

Though there is no special limitation on the relation between the work functions of the regulating blade and the development roller and the work function of the toner, it is preferable that the work functions of the regulating blade and the development roller are each set to be smaller than the work function of the toner. In this case, the toner being in contact with the regulating blade is negatively charged, thereby achieving further uniform negative charge of the toner. Voltage may be applied to the regulating blade 8 to conduct charge injection to the toner, thereby controlling the charge of the toner.

Now, description will now be made as regard to the intermediate transfer medium in the image forming apparatus of the present invention. In FIG. 1, the intermediate transfer medium 4 is fed between the photoreceptor 1 and the back-up roller 6. During this, voltage is applied, whereby the visible image on the photoreceptor 1 is transferred to the intermediate transfer medium to form a toner image on the intermediate transfer medium. Residual toner particles remaining on the photoreceptor after the transfer are removed by a cleaning blade 5 and electrostatic charge on the photoreceptor is erased by an erase lump, whereby the photoreceptor can be reusable. The image forming apparatus of the present invention can prevent reversely charged toner particles, thereby reducing the amount of toner particles remaining on the photoreceptor and thus reducing the size of a cleaning toner container.

In case that the intermediate transfer medium is a transfer drum or a transfer belt, voltage in a range from +250 V to +600 V is preferably applied as a primary transfer voltage to the conductive layer of the intermediate transfer medium. Voltage in a range from +400 V to +2800 V is preferably applied as a secondary transfer voltage for conducting the secondary transfer to the receiving medium such as a paper.

The intermediate transfer medium may be a transfer drum or a transfer belt. The transfer belt may be categorized into two types using substrates made of materials different from each other. One is a type comprising a film or a sheet made of resin having a transfer layer as an outer layer thereof and the other is a type comprising a substrate of elastic member having a transfer layer as an outer layer thereof. In case of the photoreceptor comprising a rigid drum, for example a drum made of aluminum, and an organic photosensitive layer formed on the drum, the transfer drum may be a type comprising a rigid drum substrate made of aluminum or the like and an elastic transfer layer as an outer layer formed on the drum substrate. In case of the photoreceptor, a so-called "elastic photoreceptor", i.e. comprising a belt-like substrate or an elastic substrate made of rubber and a photosensitive layer formed on the substrate, the transfer drum may be a type comprising a rigid drum substrate made of aluminum or the like and a transfer layer as an outer layer disposed directly or via a conductive intermediate layer on the drum substrate.

As the substrate, a known conductive or insulating substrate may be used. In case of the transfer belt, the volume resistivity is preferably in a range from $10^4$ to $10^{12}$ Ω cm, preferably $10^6$ to $10^{11}$ Ω cm.

As for the material and the method for forming a film or a sheet, a material prepared by dispersing a conductive material such as conductive carbon black, conductive titanium oxide, conductive tin oxide, or conductive silica into an engineering plastic such as modified polyimide, thermosetting polyimide, polycarbonate, ethylene tetrafluoroethylene copolymer, polyvinylidene fluoride, or nylon alloy is extruded or molded into a semi-conductive film substrate having a thickness of 50–500 μm and is made to be seamless substrate. Further, a surface protective layer for reducing the surface energy and preventing filming of toner is formed on the outer surface by coating fluorine to have a thickness of 5 to 50 μm.

The coating method of the surface protective layer may be a dip coating method, a ring coating method, a spray coating method, or another coating method. To prevent cracking at edges and elongation and serpentine motion of the transfer belt, tapes of polyethylene terephthalate film having a thickness of 80 μm or ribs of polyurethane rubber are attached to the edges of the transfer belt.

In case of the substrate made of a film or a sheet, the ends of the film or sheet are ultrasonic-welded so as to form a belt. As concretely described, a conductive layer and an outer layer are formed on a sheet or film before the ultrasonic welding so as to form a transfer belt having desired properties. More concretely, in case of using a polyethylene terephthalate film having a thickness of 60 to 150 μm as an insulating substrate, aluminum is deposited on the surface of the film, an intermediate conductive layer composed of a conductive material such as carbon black and resin is further coated if necessary, and a semi-conductive outer layer made of polyurethane resin, fluororesin, or conductive material having a surface resistivity higher than that of the intermediate layer is formed, thereby forming the transfer belt. In case that a resistance layer which does not need a large amount of heat for drying is allowed to be formed, the resistance layer may be formed after the ultrasonic welding of the film with aluminum deposition.

As for the material and the method for forming an elastic substrate of rubber or the like, a material prepared by dispersing the aforementioned conductive material into silicone rubber, polyurethane rubber, nitrile rubber, or ethylene propylene rubber is extruded or molded into a semi-conductive rubber belt having a thickness of 0.8 to 2.0 mm. After that, the surface of the belt is processed by an abrasive such as a sand paper or a polisher to have desired surface roughness. Though this can be used without any additional layer, a surface protective layer may be further formed thereon similarly to the above case.

The transfer drum preferably has a volume resistivity of $10^4$ to $10^{12}$ Ω cm, preferably $10^7$ to $10^{11}$ Ω cm. As the method of forming a transfer drum, a conductive elastic substrate is prepared by forming a conductive intermediate layer of an elastic material on a metallic cylinder made of aluminum or the like. Further, a semi-conductive surface protective layer for reducing the surface energy and preventing filming of toner is made by, for example, coating fluorine to have a thickness of 5 to 50 μm.

As the method for forming a conductive elastic substrate, a conductive rubber material is prepared by mixing, kneading, and dispersing a conductive material such as carbon black, conductive titanium oxide, conductive tin oxide, or conductive silica into a rubber material such as silicone rubber, polyurethane rubber, nitrile rubber (NBR), or ethylene propylene rubber (EPDM), butadiene rubber, styrene-butadiene rubber, isoprene rubber, chloroprene rubber, butyl rubber, epichlorohydrin rubber, or fluororubber. The conductive rubber material is tight wrapped onto an aluminum cylinder having a diameter of 90 to 180 mm and then ground to have a thickness of 0.8 to 6 mm and a volume resistivity of $10^4$ to $10^{10}$ Ω cm. After that, a semi-conductive outer layer made of polyurethane resin, fluororesin, conductive material, and fluorine fine particles is formed to have a thickness 15–40 μm, thereby forming a transfer drum having a desired volume resistivity of $10^7$ to $10^{11}$ Ω cm. At this point, the surface roughness is preferably 1 μm(Ra) or less. As an alternative method, a semi-conductive tube made of fluororesin or the like is covered onto a conductive elastic substrate formed in the same manner as described above and is shrank by heat, thereby forming a transfer drum having a desired outer layer and a desired electrical resistivity.

Figure 2:
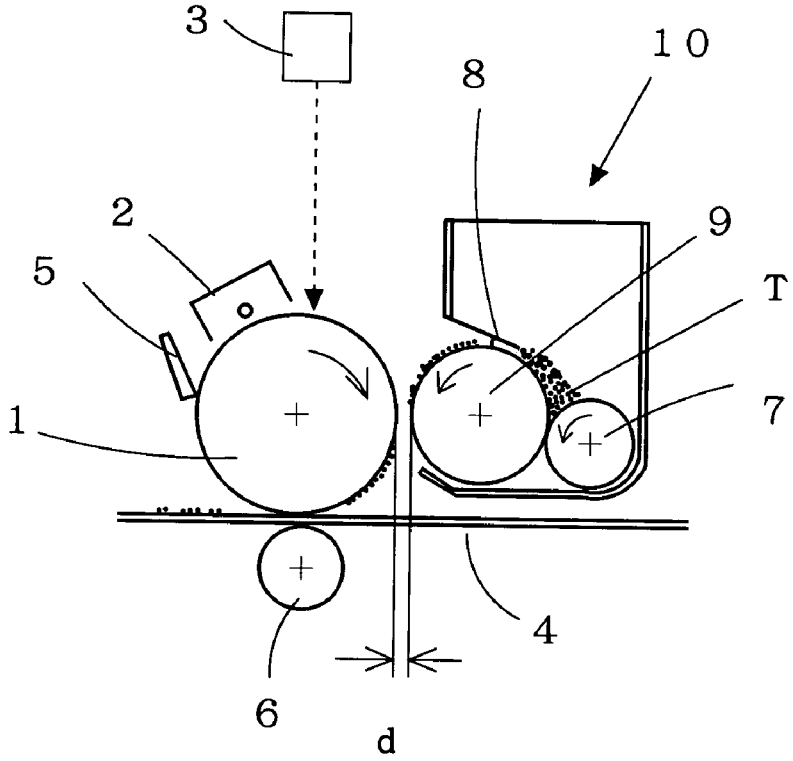
FIG. 2 is an illustration for explaining a non-contact developing process in an image forming apparatus using a toner of the present invention.

FIG. 2 shows an example of an image forming apparatus of a type employing the non-contact developing process using the toner according to the present invention. In this process, the development roller 9 and the photoreceptor 1 confront each other to have a developing gap "d" therebetween. The developing gap is preferably in a range from 100 to 350 μm. As for the developing bias, the voltage of a direct current is preferably in a range from −200 to −500 V and an alternating current to be superimposed on the direct current is preferably in a range from 1.5 to 3.5 kHz with a P-P voltage in a range from 1000 to 1800 V, but not shown. In the non-contact developing process, the peripheral velocity of the development roller which rotates in the counter-clockwise direction is preferably set to have a ratio of peripheral velocity of 1.0 to 2.5, preferably 1.2 to 2.2 relative to that of the organic photoreceptor which rotates in the clockwise direction.

The development roller 9 rotates in the counter-clockwise direction as shown in FIG. 2 with holding the toner T, supplied by the supply roller 7, adhering thereon so as to carry the toner T to a confronting portion with the organic photoreceptor. By applying a bias voltage, composed of an alternating current superimposed on a direct current, to the confronting portion between the organic photoreceptor and the development roller, the toner T vibrates between the surface of the development roller and the surface of the organic photoreceptor, thereby developing an image. In the present invention, toner particles adhere to the photoreceptor during the vibration of the toner T between the surface of the development roller and the surface of the organic photoreceptor, whereby toner particles having small-particle diameter are controlled to be negatively charged and thus may reduce the amount of fog toner particles.

The intermediate transfer medium is fed between the photoreceptor 1 with a visible image and the backup roller 6. During this, the pressing load of the intermediate transfer medium on the photoreceptor 1 by the backup roller 6 is preferably in a range from 24.5 to 58.8 N/m, preferably from 34.3 to 49 N/m which is greater than that of the contact developing process by about thirty percent.

This ensures the contact between the toner particles and the photoreceptor, whereby the toner particles can be suitably controlled to be negatively charged so as to improve the transfer efficiency.

The other items of the image forming apparatus of a type employing the non-contact developing process are the same as those of the image forming apparatus of a type employing the contact developing process.

By combining developing devices of conducting developing process as shown in FIG. 1 or FIG. 2 with respective four unicolor toners (developers) of yellow Y, cyan C, magenta M, and black K and the photoreceptor, an apparatus capable of forming a full color image can be provided.

Now, an image forming apparatus, to which negative chargeable dry type toners according to the present invention are adopted, will be described.

Figure 3:
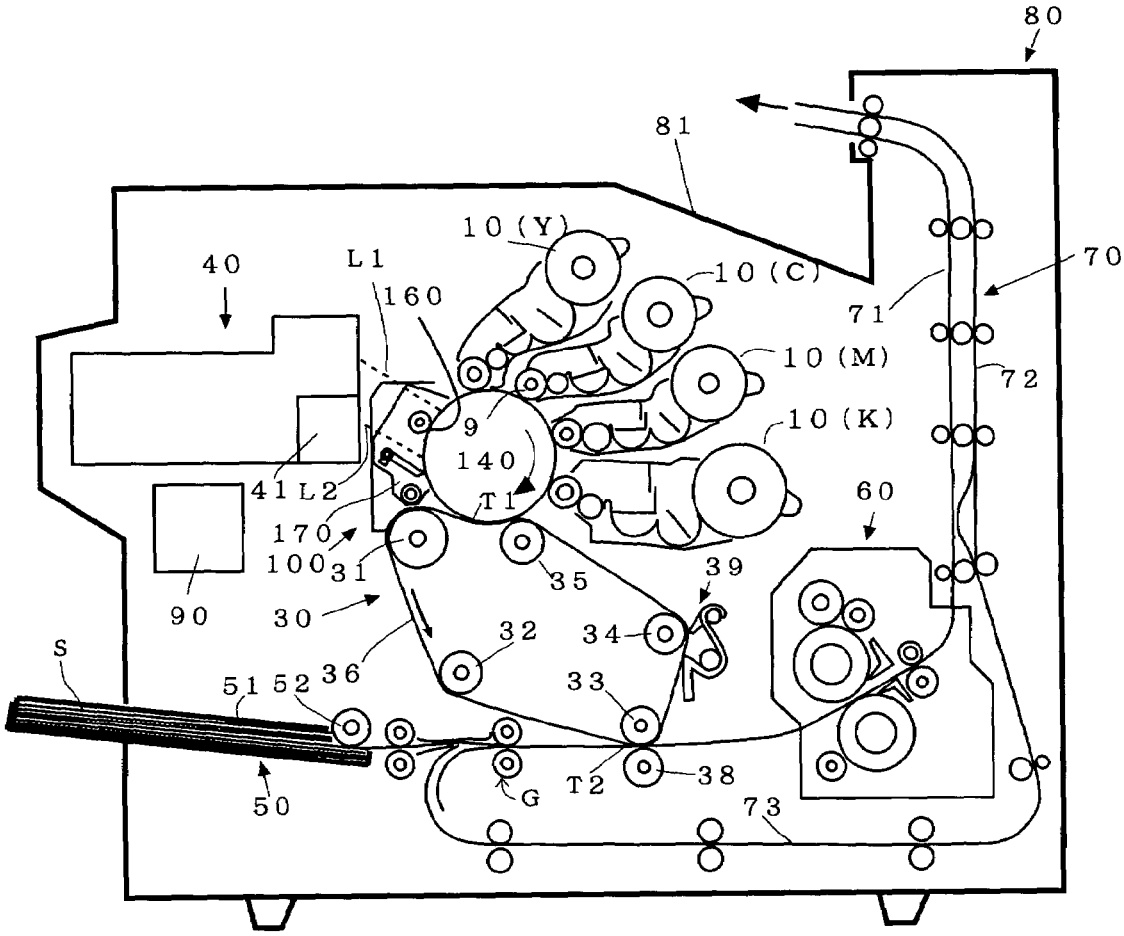
FIG. 3 is an illustration for explaining an example of a four cycle type full color printer using toners of the present invention.

FIG. 3 shows an example of a four cycle type full color image forming apparatus.

In FIG. 3, a numeral 100 designates a latent image carrier cartridge in which a latent image carrier unit is assembled. In this example, the photoreceptor cartridge is provided so that the photoreceptor and developing units can be separately installed. An electrophotographic photoreceptor (latent image carrier) 140 is rotated in a direction of arrow by a suitable driving means (not shown). Arranged around the photoreceptor 140 along the rotational direction are a charging roller 160 as the charging means, developing devices 10 (Y, M, C, K) as the developing means, an intermediate transfer device 30, and a cleaning means 170.

The charging roller 160 is in contact with the outer surface of the photoreceptor 140 to uniformly charge the outer surface of the same. The uniformly charged outer surface of the photoreceptor 140 is exposed to selective light L1 corresponding to desired image information by an exposing unit 40, thereby forming an electrostatic latent image on the photoreceptor 140. The electrostatic latent image is developed with developers by the developing devices 10.

The developing devices 10 are a developing device 10Y for yellow, a developing device 10M for magenta, a developing device 10C for cyan, and a developing device 10K for black. These developing devices 10Y, 10C, 10M, 10K can swing so that the development roller 9 of only one of the developing devices is selectively in press contact with the photoreceptor 140. These developing devices 10 hold negatively charged toners on the respective development rollers. Each developing device 10 supplies either one of toners of yellow Y, magenta M, cyan C, and black K to the surface of the photoreceptor 140, thereby developing the electrostatic latent image on the photoreceptor 140. Each development roller 9 is composed of a hard roller, for example a metallic roller which is processed to have rough surface. The developed toner image is transferred to an intermediate transfer belt 36 of the intermediate transfer device 30. The cleaning means 170 comprises a cleaner blade for scraping off toner particles T adhering to the outer surface of the photoreceptor 140 after the transfer and a toner receiving portion for receiving the toner particles scrapped by the cleaner blade.

The intermediate transfer device 30 comprises a driving roller 31, four driven rollers 32, 33, 34, 35, and the endless intermediate transfer belt 36 laid around these rollers with some tension. The driving roller 31 has a gear (not shown) fixed at the end thereof and the gear is meshed with a driving gear of the photoreceptor 140 so that the driving roller 31 is rotated at substantially the same peripheral velocity as the photoreceptor 140. As a result, the intermediate transfer belt 36 is driven to circulate at substantially the same peripheral velocity as the photoreceptor 140 in the direction of arrow in FIG. 3.

The driven roller 35 is disposed at such a position that the intermediate transfer belt 36 is in press contact with the photoreceptor 140 by the tension itself between the driving roller 31 and the driven roller 35, thereby providing a primary transfer portion T1 at the press contact portion between the photoreceptor 140 and the intermediate transfer belt 36. The driven roller 35 is disposed near the primary transfer portion T1 on the upstream side in the circulating direction of the intermediate transfer belt.

On the driving roller 31, an electrode roller (not shown) is disposed via the intermediate transfer belt 36. A primary transfer voltage is applied to a conductive layer of the intermediate transfer belt 36 via the electrode roller. The driven roller 32 is a tension roller for biasing the intermediate transfer belt 36 in the tensioning direction by a biasing means (not shown). The driven roller 33 is a backup roller for providing a secondary transfer portion T2. A secondary transfer roller 38 is disposed to confront the backup roller 33 via the intermediate transfer belt 36. A secondary transfer voltage is applied to the secondary transfer roller. The secondary transfer roller can move apart from or to come in contact with the intermediate transfer belt 36 by a sifting mechanism (not shown). The driven roller 34 is a backup roller for a belt cleaner 39. The belt cleaner 39 can move apart from or to come in contact with the intermediate transfer belt 36 by a shifting mechanism (not shown).

The intermediate transfer belt 36 is a dual-layer belt comprising the conductive layer and a resistive layer formed on the conductive layer, the resistive layer being brought in press contact with the photoreceptor 140. The conductive layer is formed on an insulating substrate made of synthetic resin. The primary transfer voltage is applied to the conductive layer through the electrode roller as mentioned above. The resistive layer is removed in a band shape along the side edge of the belt so that the corresponding portion of the conductive layer is exposed in the band shape. The electrode roller is arranged in contact with the exposed portion of the conductive layer.

In the circulating movement of the intermediate transfer belt 36, the toner image on the photoreceptor 140 is transferred onto the intermediate transfer belt 36 at the primary transfer portion T1, the toner image transferred on the intermediate transfer belt 36 is transferred to a recording medium S such as a paper sheet supplied between the secondary transfer roller 38 and the intermediate transfer belt at the secondary transfer portion T2. The sheet S is fed from a sheet feeder 50 and is supplied to the secondary transfer portion T2 at a predetermined timing by a pair of gate rollers G. Numeral 51 designates a sheet cassette and 52 designates a pickup roller.

The toner image is fixed at the fixing device 60 and is discharged through a discharge path 70 onto a sheet tray 81 formed on a casing 80 of the apparatus body. The image forming apparatus of this example has two separate discharge paths 71, 72 as the discharge path 70. The sheet after the fixing device 60 is discharged through either one of the discharge paths 71, 72. The discharge paths 71, 72 have a switchback path through which a sheet passing through the discharge path 71 or 72 is returned and fed again through a return roller 73 to the secondary transfer portion T2 in case of forming images on both sides of the sheet.

The actions of the image forming apparatus as a whole will be summarized as follows:

(1) As image information is inputted into a control unit 90 of the image forming apparatus from a personal computer (not shown) or the like, the photoreceptor 140, the respective rollers 9 of the developing devices 10, and the intermediate transfer belt 36 are driven to rotate.

(2) The outer surface of the photoreceptor 140 is uniformly charged by the charging roller 160.

(3) The uniformly charged outer surface of the photoreceptor 140 is exposed to selective light L1 corresponding to image information for a first color (e.g. yellow) by the exposure unit 40, thereby forming an electrostatic latent image for yellow.

(4) Only the development roller of the developing device 10Y for yellow as the first color is brought in contact with the photoreceptor 140 so as to develop the aforementioned electrostatic latent image, thereby forming a toner image of yellow as the first color on the photoreceptor 140.

(5) The primary transfer voltage of the polarity opposite to the polarity of the toner is applied to the intermediate transfer belt 36, thereby transferring the toner image formed on the photoreceptor 140 onto the intermediate transfer belt 36 at the primary transfer portion T1. At this point, the secondary transfer roller 38 and the belt cleaner 39 are kept away from the intermediate transfer belt 36.

(6) After residual toner particles remaining on the photoreceptor 140 are removed by the cleaning means 170, the charge on the photoreceptor 140 is removed by removing light L2 from a removing means 41.

(7) The above processes (2)–(6) are repeated as necessary. That is, according to the printing command, the processes are repeated for the second color, the third color, and the forth color and the toner images corresponding to the printing command are superposed on each other on the intermediate transfer belt 36.

(8) A sheet S is fed from the sheet feeder 50 at a predetermined timing, the toner image, that is, a full color image formed by superposing the four toner colors, on the intermediate transfer belt 36 is transferred onto the sheet S with the secondary transfer roller 38 immediately before or after an end of the sheet S reaches the secondary transfer portion T2, namely, at a timing as to transfer the toner image on the intermediate transfer belt 36 onto a desired position of the sheet S. The belt cleaner 39 is brought in contact with the intermediate transfer belt 36 to remove toner particles remaining on the intermediate transfer belt 36 after the secondary transfer.

(9) The sheet S passes through the fixing device 60 whereby the toner image on the sheet S is fixed. After that, the sheet S is carried toward a predetermined position (toward the sheet tray 81 in case of single-side printing, or toward the return roller 73 via the switchback path 71 or 72 in case of dual-side printing).

In the image forming apparatus according to the present invention, the development rollers 9 and the intermediate transfer medium 36 may be brought in contact with the photoreceptor 140, and a non-contact developing method may be employed.

Figure 4:
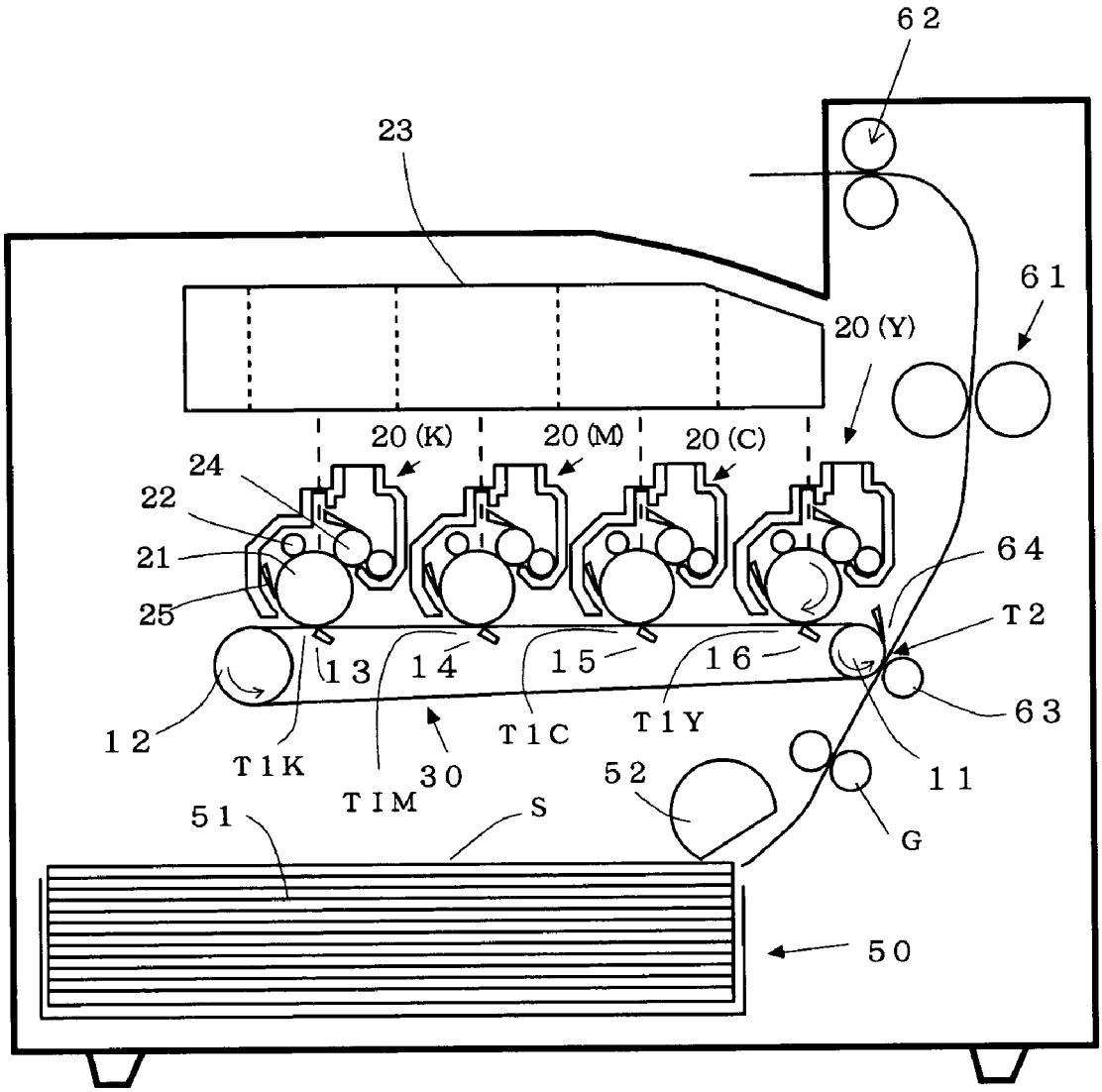
FIG. 4 is a schematic front view of a tandem-type full color printer using toners of the present invention.

A schematic front view of a full color printer of the tandem type to be used in the present invention is shown in FIG. 4. In this case, the photoreceptor and the developing unit are combined in one unit, that is, can be installed as a process cartridge to the apparatus. Though this example is of a type employing the contact development process, the apparatus maybe of a type employing the non-contact development process.

The image forming apparatus comprises an intermediate transfer belt 30 which is laid around only two rollers, i.e. a driving roller 11 and a driven roller 12, with some tension and is driven to circulate in a direction of arrow (the counter-clockwise direction), and four unicolor toner image forming means 20(Y), 20(C), 20(M), 20(K) arranged along the intermediate transfer belt 30. Respective toner images formed by the unicolor toner image forming means 20 are sequentially primarily transferred to the intermediate transfer belt 30 by transfer means 13, 14, 15, 16, respectively. The respective primary transfer portions are indicated with T1Y, T1C, T1M, and T1K.

As the unicolor toner image forming means, there are 20(Y) for yellow, 20(M) for magenta, 20(C) for cyan, and 20(K) for black. Each of these unicolor toner image forming means 20(Y), 20(C), 20(M), 20(K) comprises a photoreceptor 21 having a photosensitive layer on its outer surface, a charging roller 22 as charging means for uniformly charging the outer surface of the photoreceptor 21, an exposure means 23 for selectively exposing the outer surface of the photoreceptor 21, uniformly charged by the charging roller 22, so as to form an electrostatic latent image, a development roller 24 as development mean for developing the electrostatic latent image, formed by the exposure means 23, with developer or toner so as to form a visible image (toner image), and a cleaning blade 25 as cleaning means for removing toner particles remaining on the surface of the photoreceptor 21 after the toner image is transferred to the intermediate transfer belt 30 as the primary transfer medium.

These unicolor toner image forming means 20(Y), 20(C), 20(M), 20(K) are arranged on a loose side of the intermediate transfer belt 30. Toner images are sequentially transferred to the intermediate transfer belt 30 and sequentially superposed on each other on the intermediate transfer belt 30 so as to form a full color toner image. The full color toner image is secondarily transferred to a recording medium S such as a paper sheet at a secondary transfer portion T2 and is fixed on the recording medium S by passing between a pair of fixing rollers 61. After that, the recording medium S is discharged by a pair of discharge rollers 62 to a predetermine location, that is, an output sheet tray (not shown). Numeral 51 designates a sheet cassette for holding recording media S in a piled state, 52 designates a pickup roller for feeding the recording media S one by one from the sheet cassette 51, G designates a pair of gate rollers for defining the feeding timing of the recording medium S to the secondary transfer portion T2.

Numeral 63 designate a secondary transfer roller as secondary transfer means for cooperating with the intermediate transfer belt 30 to provide the secondary transfer portion T2 therebetween, 64 designates a cleaning blade as cleaning means for removing toner particles remaining on the surface of the intermediate transfer belt 30 after the secondary transfer. The cleaning blade 64 is in contact with the intermediate transfer belt 30 at a wrapping portion of the intermediate transfer belt 30 around the driving roller 11 not the driven roller 12.

Hereinafter, the present invention will be described with reference to Examples.

(Product Example of Organic Photoreceptor (OPC 1))

An aluminum pipe of 85.5 mm in diameter was used as a conductive substrate. A coating liquid was prepared by dissolving and dispersing 6 parts by weight of nylon resin (available from Toray Industries, Inc.: CM8000) and 4 parts by weight of titanium oxide fine particles treated with aminosilane into 100 parts by weight of methanol. The coating liquid was coated on the peripheral surface of the conductive substrate by the ring coating method and was dried at a temperature 100° C. for 40 minutes, thereby forming an undercoat layer having a thickness of 1.5 to 2 μm.

A dispersion liquid was prepared by dispersing 1 part by weight of oxytitanium phthalocyanine as a charge generation agent, 1 part by weight of butyral resin (available from Sekisui Chemical Co., Ltd.: BX-1), into 100 parts by weight of dichloroethane for 8 hours by a sand mill with glass beads of 1 mm in diameter. The dispersion liquid was applied on the undercoat layer by the ring coating method and was dried at a temperature of 80° C. for 20 minutes, thereby forming a charge generation layer having a thickness of 0.3 μm.

A liquid was prepared by dissolving 40 parts by weight of charge transport material of a styryl compound having the following structural formula (1) and 60 parts by weight of polycarbonate resin (available from Teijin Chemicals Ltd.: Panlite TS) into 400 parts by weight of toluene. The liquid was applied on the obtained charge generation layer by the dip coating to have a thickness of 22 μm when dried, thereby forming a charge transport layer. In this manner, an organic photoreceptor (1) having a double-layer type photosensitive layer consisting of the charge generation layer and the charge transport layer was obtained.

Structural Formula (1)

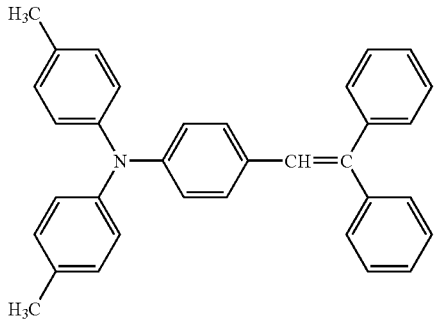

A test piece was made by cutting a part of the obtained organic photoreceptor and was measured by using a surface analyzer (produced by Riken Keiki Co.: LtdAC-2) with radiation amount of 500 nW. The measured work function was 5.48 eV.

(Product Example of Organic Photoreceptor (OPC 2))

An organic photoreceptor (OPC 2) was obtained in the same manner as the above organic photoreceptor (OPC 1) except that a nickel electroforming pipe having a thickness 40 μm was employed as the conductive substrate and a distyryl compound having the following structural formula (2) was employed as the charge transport material. The work function of the obtained organic photoreceptor was measured in the same manner as mentioned above. The work function was 5.50 eV.

Structrual Formula (2)

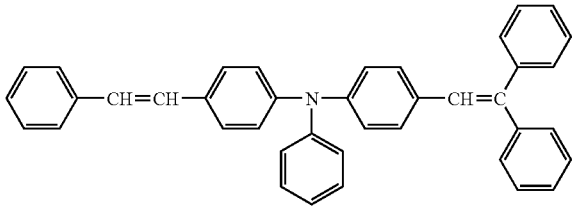

(Product Example of Development Roller)

An aluminum pipe of 18 mm in outer diameter was surfaced with nickel plating of 23 μm in thickness to have surface roughness (Ra) of 4 μm, thereby obtaining a development roller. The surface of the obtained development roller was partially cut for measuring the work function and the work function was measured with radiation amount of 10 nW in the same manner as the organic photoreceptor. The work function was 4.58 eV.

(Product Example of Regulating Blade)

Conductive polyurethane rubber tips of 1.5 mm in thickness were attached to a stainless steel plate of 80 μm in thickness by conductive adhesive, thereby making a rubber regulating blade. The work function of the polyurethane rubber portion was measured with radiation amount of 500 nW in the same manner as the organic photoreceptor. The work function was 5 eV.

(Product Example of Transfer Belt)

Production of the Transfer Medium 1

A uniformly dispersed liquid composed of 30 parts by weight of vinyl chloride-vinyl acetate copolymer, 10 parts by weight of conductive carbon black, and 70 parts by weight of methanol was applied on a polyethylene terephthalate film of 130 μm in thickness with aluminum deposited thereon by the roll coating method to have a thickness of 20 μm and dried to form an intermediate conductive layer.

Then, a coating liquid was made by mixing and dispersing the following components: 55 parts by weight of nonionic aqueous polyurethane resin (solid ratio: 62%), 11.6 parts by weight of polytetrafluoroethylene emulsion (solid ratio: 60%), 25 parts by weight of conductive tin oxide, 34 parts by weight of polytetrafluoroethylene fine particles (maximum particle diameter: 0.3 μm or less), 5 parts by weight of polyethylene emulsion (solid ratio: 35%), and 20 parts by weight of ion exchanged water. The obtained coating liquid was coated on the intermediate conductive layer by the roll coating method to have a thickness of 10 μm when dried.

The obtained coated sheet was cut to have a length of 540 mm. The ends of the cut piece are superposed on each other and welded by ultrasonic to form a circular band shape, thereby making a transfer belt. The volume resistivity of this transfer belt was $2.5\times10^{10}$ Ω cm. The work function was 5.37 eV and the normalized photoelectron yield was 6.90.

(External Additive 1)

100 g of silica particles (having a specific surface area of $130m^2/g$) made in the vapor-phase-process were dispersed in 2000 ml water and heated to 70° C. of water temperature. 250 ml aqueous solution of titanium sulfate containing $TiO_2$ in an amount 100 g per 1 liter and 5 N aqueous solution of sodium hydrate were dropped at the same time until pH became 6.0. After that, thus obtained solution was cooled to 40° C. of water temperature and adjusted to have pH 4.0. Successively, 25 g of n-hexyltrimethoxysilane was added. After stirring the mixture for 4 hours, 2N aqueous solution of sodium hydrate was added to adjust its pH to 6.5. After further stirring the mixture for 2 hours, the mixture was filtered and cleaned, and then dried. The dried matter was pulverized by a pulverizing machine, thus obtaining an external additive having surfaces modified with oxide. The specific surface area of the external additive was 88.4 $m^2/g$ and the hydrophobic degree of the external additive was 62.5%.

The hydrophobic degree was measured as follows:

(Hydrophobic Degree)

Aqueous solutions having different methanol concentrations were prepared. Each 10 ml aqueous solution of methanol was entered in a test tube with ground-in stopper of 25 ml. 10 mg of a sample to be measured was entered. Precipitation was observed by observer's eyes. The methanol concentration (% by mass) at the start of the precipitation was represented as the hydrophobic degree (%)

(External Additive 4)

An external additive was prepared in the same manner as the external additive 1 except that 100 ml aqueous solution of tin chloride containing tin oxide ($SnO_2$) in an amount 100 g per 1 liter was dropped instead of the titanium sulfate. The same treatment after that was conducted, thereby obtaining an external additive having surfaces modified with tin oxide. The specific surface area of the external additive was 102.5 $m^2/g$ and the hydrophobic degree of the external additive was 57.5%.

EXAMPLE 1

(Production of Toner Mother Particles 1)

100 parts by weight of a mixture (available from Sanyo Chemical Industries, Ltd.: Himer ES-803) which was 50:50 (by weight) of polycondensate polyester, composed of aromatic di-carboxylic acid and bisphenol A of alkylene ether, and partially crosslinked compound of the polycondensate polyester by polyvalent metal, 5 parts by weight of Phthalocyanine Blue, 3 part by weight of polypropylene (having a melting point of 152° C. and a weight-mean molecular weight of 4000), and 4 parts by weight of metal complex compound of salicylic acid (available from Orient Chemical Industries, Ltd.: E-81) as a charge control agent were uniformly mixed by using a Henschel mixer, then kneaded by a twin-shaft extruder at a temperature of 150° C., and then cooled. The cooled matter was roughly pulverized into pieces of 2 square mm or less and then pulverized into fine particles by a jet mill. The fine particles were classified, thereby obtaining toner mother particles having a number-mean particle diameter of 7.6 μm and a degree of circularity of 0.91.

The work function of the toner mother particles 1 was measured by a surface analyzer (produced by Riken Keiki Co., Ltd: AC-2) with radiation amount of 500 nW. The measured value was 5.46 eV.

The external additive 1 composed of silica particles (having a specific surface area of 88.4 $m^2/g$ and a hydrophobic degree of 62%) of which surfaces are modified with titanium oxide was added to the toner mother particles 1, thereby preparing a toner.

With the obtained toner, an image was formed to have a solid image density in the order of 1.1–1.2 according to the non-contact developing process by using the full color image forming apparatus as shown in FIG. 3 employing the OPC 1 as the photoreceptor with a developing gap set to 220 μm under the following conditions: the dark potential was −600 V, the light potential was −80 V, the direct current developing bias was −300 V, the alternate current bias was 1.35 kV, frequency was 2.5 kHz, and the obtained toner was loaded into the cyan developing device.

During this, the charging property of the toner on the development roller was measured by a charge distribution measuring system (produced by Hosokawa Micron Corporation: E-SPART analyzer EST-3). The results of the measurements are shown in Table 1.

The amount of positively charged toner was the mass of the positively charged toner in 3000 toner particles and indicated in % by mass.

TABLE 1

| | External additive 1 (parts by wt) | Mean charge amount q/m (μc/g) | Amount of positively charged toner (% by mass) |
|---|---|---|---|
| | | Image Formation | |
| Sample 1-1 | None | Failure | — |
| Sample 1-2 | 0.25 | −14.12 | 5.1 |
| Sample 1-3 | 0.5 | −13.51 | 7.8 |
| Sample 1-4 | 1.0 | −10.34 | 16.9 |

When the silica fine particles of which surfaces are modified with titanium oxide are added as the external additive, the toner is negatively charged as mentioned above. However, as the adding amount of the silica fine particles is increased, the amount of negatively charged toner is reduced while the amount of positively charged toner is increased.

Next, 0.25 parts by weight of the external additive 1 and 0.25 parts by weight of rutile type titania (having a specific surface area of 72 $m^2/g$), anatase type titania (having a specific surface area of 93 $m^2/g$), alumina (having a specific surface area of 100 $m^2/g$), or silica (having a number-mean primary particle diameter of 16 nm) as the external additive 2 as shown in Table 2 were added to 100 parts by weight of the aforementioned toner mother particles. In this manner, toners as Sample 1-5, Sample 1-6, Sample 1-7, and Sample 1-8 were prepared. As for each of the thus prepared toners, the charging property of the toner on the development roller was measured in the same manner as mentioned above. The results are shown in Table 2.

TABLE 2

| | External additive 1 (parts by wt) | External additive 2 kind | Mean charge amount q/m (μc/g) | Amount of positively charged toner (% by mass) |
|---|---|---|---|---|
| | | Rutile type | | |
| Sample 1-5 | 0.25 | titania | −13.09 | 7.5 |
| | | Anatase type | | |
| Sample 1-6 | 0.25 | titania | −13.23 | 5.7 |
| Sample 1-7 | 0.25 | Alumina | −20.39 | 11.9 |
| Sample 1-8 | 0.25 | Silica | −13.16 | 3.3 |

As apparent from Sample 1-8, by using silica together with the external additives 1 having silica of which surfaces are modified with titania, the amount of positively charged toner, i.e. toner having reverse polarity, became smaller without excessively charging the mean charge amount of negative charging in comparison with Sample 1-2 through Sample 1-7. Especially from Sample 1-8, it was found that the amount of positively charged toner, i.e. toner having reverse polarity, can be reduced without excessively charging the mean charge amount of negative charging.

EXAMPLE 2

(Production of Toner Mother Particles 2)

Toner mother particles 2 were obtained in the same manner as Example 1 except that Carmin 6B was used instead of the Phthalocyanine Blue used in the above toner mother particles 1 of Example 1. In this manner, a toner having a number-mean particle diameter 6.2 μm and a degree of circularity of 0.905 was obtained.

The classified toner was surface-treated by adding hydrophobic silica (having a number-mean particle diameter of 7 nm and a specific surface area of 250 $m^2/g$) in an amount of 0.2 parts by weight relative to 100 parts by weight of the classified toner and then was partially spheroidized by using a hot air spheroidizing apparatus (available from Nippon Pneumatic Mfg. Co., Ltd.: SFS-3) at a treatment temperature of 250° C. After that, the surface-treated toner was classified again in the same manner, thereby forming toner mother particles for a magenta toner having a number-mean particle diameter of 7.35 μm and a degree of circularity of 0.940. The work function of the toner mother particles 2 was measured in the same manner as Example 1 and the result of the measurement was 5.50 eV.

To the toner mother particles 2, 1 parts by weight of the external additive 1 (having a specific surface area 88.4 m2/g and a hydrophobic degree of 62%), composed of silica particles having surfaces modified with titanium oxide, and 0.5 parts by weight, 1.0 parts by weight, 1.1 parts by weight, 2.0 parts by weight, or 2.5 parts by weight of hydrophobic silica (having a specific surface area of 137 $m^2/g$ and a mean particle diameter of primary particles of 12 nm) as the external additive 2 were added relative to 100 parts by weight of the toner mother particles 2. In this manner, toners as Sample 2-1, Sample 2-2, Sample 2-3, Sample 2-4, and Sample 2-5 were prepared.

Then, image formation was conducted by using the respective obtained toners in the same manner as Example 1. In addition, the charging property of the toner on the development roller during the image formation was measured in the same manner as mentioned above. The results are shown in Table 3.

TABLE 3

| | External additive 1 (parts by wt) | External additive 2 (parts by wt) | Mean charge amount q/m (μc/g) | Amount of positively charged toner (% by mass) |
|---|---|---|---|---|
| Sample 2-1 | 1 | 0.5 | −12.94 | 11.3 |
| Sample 2-2 | 1 | 1 | −12.68 | 9.0 |
| Sample 2-3 | 1 | 1.1 | −12.31 | 9.2 |
| Sample 2-4 | 1 | 2 | −11.31 | 13.6 |
| Sample 2-5 | 1 | 2.5 | −9.75 | 16.1 |

When the mixing ratio of the hydrophobic silica of the external additive 2 relative to the silica having surfaces modified with titania of the external additive 1 was 1:1, the amount of positively charged toner i.e. toner having reverse polarity was 9.0% which was the minimum value. When the adding amount of the hydrophobic silica was further increased, there is a tendency to slightly reduce the mean charge amount of negative charging and to increase the amount of positively charged toner i.e. toner having reverse polarity.

EXAMPLE 3

(Production of Toner Mother Particles 3)

A monomer mixture composed of 80 parts by weight of styrene monomer, 20 parts by weight of butyl acrylate, and 5 parts by weight of acryl acid was added into a water soluble mixture composed of 105 parts by weight of water, 1 part by weight of nonionic emulsifier, 1.5 parts by weight of anionic emulsifier, and 0.55 parts by weight of potassium persulfate and was agitated and polymerized in nitrogen gas atmosphere at a temperature of 70° C. for 8 hours.

By cooling after polymerization reaction, milky white resin emulsion having a particle size of 0.25 μm was obtained. Then, a mixture composed of 200 parts by weight of resin emulsion obtained above, 20 parts by weight of polyethylene wax emulsion (available from Sanyo Chemical Industries, Ltd.: Permarin PN), and 7 parts by weight of Phthalocyanine Blue was dispersed into water containing dodecyl benzene sulfonic acid sodium in an amount of 0.2 parts by weight, and was adjusted to have pH of 5.5 by adding diethyl amine. After that, electrolyte aluminum sulfate was added in an amount of 0.3 parts by weight with agitation and subsequently agitated at a high speed and thus dispersed by using an emulsifying and dispersing device (manufactured by Tokushu Kika Kogyo Co., Ltd.: TK homo mixer).

Further, 40 parts by weight of styrene monomer, 10 parts by weight of butyl acrylate, and 5 parts by weight of zinc salicylate were added with 40 parts by weight of water, agitated in nitrogen gas atmosphere, and heated at a temperature of 90° C. in the same manner. By adding hydrogen peroxide, polymerization was conducted for 5 hours to grow up particles. After the polymerization, the pH was adjusted to be 5 or more while the temperature was increased to 95° C. and then maintained for 5 hours in order to improve the bonding strength of associated particles.

After that, the obtained particles were washed with water and dried under vacuum at a temperature of 45° C. for 10 hours. In this manner, mother particles 3 for cyan toner having mean particle diameter 6.8 μm and a degree of circularity of 0.98 were obtained.

The work function of the mother particles 3 was measured by using the surface analyzer in the same manner as Example 1 and the measured value was 5.59 eV. To 100 parts by weight of the toner mother particles 3, negatively chargeable hydrophobic silica, having a number-mean primary particle diameter of 7 nm, surface-treated with hexamethyldisilazane (HMDS) was added in an amount of 0.5 parts weight as the external additive 2 and negatively chargeable hydrophobic silica, having a mean particle diameter of 40 nm, surface-treated by the same treatment was added as the external additive 3 in an amount of 0.5 parts by weight. After that, the external additive 1 of the present invention was added and mixed. In this manner, Sample 3-1 through Sample 3-9 were prepared.

Then, image formation was conducted by using the respective obtained toners in the same manner as Example 1. In addition, the charging property of the toner on the development roller during the image formation was measured in the same manner as mentioned above. The results are shown in Table 4.

TABLE 4

| | External additive 1 (parts by wt) | External additive 2 (parts by wt) | External additive 3 (parts by wt) | Mean charge amount q/m (μc/g) | Amount of positively charged toner (% by mass) |
|---|---|---|---|---|---|
| Sample 3-1 | 0 | 0.5 | 0.5 | −20.32 | 8.27 |
| Sample 3-2 | 0.1 | 0.5 | 0.5 | −20.55 | 2.31 |
| Sample 3-3 | 0.25 | 0.5 | 0.5 | −21.96 | 0.86 |
| Sample 3-4 | 0.5 | 0.5 | 0.5 | −20.16 | 0.39 |
| Sample 3-5 | 1.0 | 0.5 | 0.5 | −19.88 | 0.73 |
| Sample 3-6 | 1.1 | 0.5 | 0.5 | −17.30 | 1.99 |
| Sample 3-7 | 1.5 | 0.5 | 0.5 | −12.67 | 8.39 |
| Sample 3-8 | 2.0 | 0.5 | 0.5 | −8.20 | 13.01 |
| Sample 3-9 | 3.0 | 0.5 | 0.5 | −4.39 | 37.07 |

In the toner 3 of the present invention, by using the silica having surfaces modified with titania as the external additive 1 together with the silica having a smaller number-mean primary particle diameter (7 nm) as the external additive 2 and the silica having a larger number-mean primary particle diameter (about 40 nm) as the external additive 3, it is possible to increase the mean charge amount and reduce the amount of positively charged toner i.e. toner having reverse polarity. There is a tendency to reduce the mean charge amount and increase the amount of positively charged toner i.e. toner having reverse polarity when the ratio of the external additive 1 relative to the total of the external additive 2 and the external additive 3 exceeds 1.1. Therefore, as for the adding amount, the mean charge amount is not lowered when the ratio is less than 1:1 and it is possible to reduce the amount of reversely charged toner compared to the toner without adding the external additive 1 as a comparative example when the ratio is less than 1:1.5. This result leads to the improvement of transfer efficiency and the reduction in amount of fog toner and amount of reversely transferred toner compared to the toner without adding the external additive 1, in the evaluation of the image forming characteristics as described below.

The evaluation of the image forming characteristics was made by using the full color image forming apparatus shown in FIG. 3 with the development rollers, the regulating blade, and the intermediate transfer belt as mentioned above.

The peripheral velocities of the organic photoreceptor and the intermediate transfer belt were set such that the peripheral velocity of the intermediate transfer belt was higher than that of the organic photoreceptor by 1.03 times. The OPC 1 was used in case of contact development and the OPC 2 was used in case of non-contact development. As conditions for printing according to the contact development, the dark potential was set to −600 V, the light potential was set to −80 V, the direct current developing bias voltage was set to −300 V, and the development roller and the supply roller are set to have the same potential. As conditions for printing according to the non-contact development, the developing gap was set to 220 μm, the dark potential was set to −600 V, the light potential was set to −80 V, the direct current developing bias was set to −300 V, the alternating current bias was set to 1.35 kV, the frequency of the alternating current was set to 2.5 kHz, and the development roller and the supply roller are set to have the same potential. Images were formed to have a solid image density in the order of 1.3. At this point, the degree of fog toner on the organic photoreceptor was measured by the following manner. That is, an adhesive tape (available from Sumitomo 3M Ltd.: mending tape 801-1-18) was attached onto the toner, and then attached on a white plain paper. The density was measured from above the tape by a reflection densitometer (manufactured by X-Rite, Inc.: X-Rite 404). "OD" value of reversely transferred toner was obtained by subtracting the value of density at a portion where only the tape without toner was attached from the measured value.

On the other hand, the transfer efficiency was obtained by attaching such tapes on to toner existing on the photoreceptor before and after the transfer, measuring the masses of the tapes, and calculating a difference therebetween. The amount of reverse transfer toner was obtained as follows. The ratio of the difference relative to the mass of tape before the transfer was shown in percentage and defined as the transfer efficiency.

Toner reversely transferred from the transfer belt to the organic photoreceptor during printing with the second color was also measured. The measured values are shown in Table 5. By adding the external additive, both the amount of fog toner and the amount of the reversely transferred toner were reduced and the transfer efficiency was improved both in the contact development and the non-contact development.

TABLE 5

| | Contact Development OD value | | | Non-contact Development OD value | | |
|---|---|---|---|---|---|---|
| | Fog toner | Reversely transferred toner | Transfer efficiency (%) | Fog toner | Reversely transferred toner | Transfer efficiency (%) |
| Sample 3-1 | 0.028 | 0.015 | 98.6 | 0.015 | 0.013 | 95.5 |
| Sample 3-2 | 0.010 | 0.006 | 99.0 | 0.006 | 0.004 | 96.0 |
| Sample 3-3 | 0.006 | 0.003 | 99.1 | 0.004 | 0.001 | 96.2 |
| Sample 3-4 | 0.002 | 0.002 | 99.4 | 0.003 | 0.001 | 97.9 |
| Sample 3-5 | 0.006 | 0.003 | 99.4 | 0.004 | 0.000 | 98.8 |
| Sample 3-6 | 0.011 | 0.004 | 99.2 | 0.009 | 0.002 | 98.7 |
| Sample 3-7 | 0.028 | 0.006 | 98.5 | 0.020 | 0.012 | 98.2 |
| Sample 3-8 | 0.058 | 0.008 | 97.9 | 0.056 | 0.014 | 97.9 |
| Sample 3-9 | 0.248 | 0.020 | 94.4 | 0.089 | 0.044 | 97.5 |

EXAMPLE 4

Toners were prepared in the same manner as Example 3 except that anatase type titania (having a specific surface area of 93 $m^2/g$) was added as the external additive 1. As for each toner, evaluation was made in the same manner as the toners of Example 3. The results are shown in Table 6.

TABLE 6

| | External additive 1 (parts by wt) | Mean charge amount q/m (μc/g) | Amount of positively charged toner (% by mass) |
|---|---|---|---|
| Sample 3-1 | 0 | −20.32 | 8.27 |
| Sample 3-3 | 0.25 (Invention) | −21.96 | 0.86 |
| Sample 4-1 | 0.25 (Anatase) | −20.11 | 2.83 |
| Sample 3-4 | 0.5 (Invention) | −20.16 | 0.39 |
| Sample 4-2 | 0.5 (Anatase) | −17.14 | 2.56 |
| Sample 3-5 | 1.0 (Invention) | −19.88 | 0.73 |
| Sample 4-2 | 1.0 (Anatase) | −10.66 | 6.37 |
| Sample 3-8 | 2.0 (Invention) | −8.20 | 13.01 |
| Sample 4-3 | 2.0 (Anatase) | −4.91 | 25.95 |
| Sample 3-9 | 3.0 (Invention) | −4.39 | 37.07 |
| Sample 4-4 | 3.0 (Anatase) | −2.85 | 37.24 |

The mean charge amount can be higher and the amount of positively charged toner i.e. toner having reverse polarity can be smaller by adding the silica particles having surfaces modified with oxide of the present invention, as compared to samples adding anatase type titanium oxide.

Therefore, the same effect or more can be obtained by using the external additive as the fluidity improving agent according to the present invention in an amount about half of the adding amount of titania conventionally used. As a result of reduction in adding amount, the fixing property can be improved.

EXAMPLE 5

(Production of Mother Particles 3 of Magenta Toner)

Mother particles 3 of magenta toner were obtained in the same manner as Example 3 except that Quinacridon was used as the pigment. The mother particles 3 of magenta toner had a mean particle diameter of 7.0 μm, a degree of circularity of 0.976, and a work function of 5.64 eV.

To 100 parts by weight of the mother particles 3 of magenta toner, 0.5 parts by weight of the external additive 2 and 0.5 parts by weight of the external additive 3 were added and mixed in the same manner as Example 3 and, after that, the external additive 4 of the present invention was added and mixed, thereby forming toners as Sample 5-1 through Sample 5-5.

Then, image formation was conducted by using the respective obtained toners in the same manner as Example 1. In addition, the charging property of the toner on the development roller during the image formation was measured in the same manner as mentioned above. The results are shown in Table 7.

TABLE 7

| | External additive 4 (parts by wt) | External additive 2 (parts by wt) | External additive 3 (parts by wt) | Mean charge amount q/m (μc/g) | Amount of positively charged toner (% by mass) |
|---|---|---|---|---|---|
| Sample 5-1 | 0 | 0.5 | 0.5 | −23.56 | 13.27 |
| Sample 5-2 | 0.1 | 0.5 | 0.5 | −22.59 | 5.73 |
| Sample 5-3 | 0.25 | 0.5 | 0.5 | −21.64 | 3.50 |
| Sample 5-4 | 0.5 | 0.5 | 0.5 | −18.83 | 6.80 |
| Sample 5-5 | 0.9 | 0.5 | 0.5 | −16.28 | 9.35 |
| Sample 5-6 | 1.0 | 0.5 | 0.5 | −14.53 | 12.90 |
| Sample 5-7 | 1.1 | 0.5 | 0.5 | −11.41 | 13.39 |

In the mother particles of magenta toner of the present invention, by using the silica having surfaces coated with tin oxide as the external additive 4 together with the silica having a smaller number-mean primary particle diameter (7 nm) as the external additive 2 and the silica having a larger number-mean primary particle diameter (40 nm) as the external additive 3, it is possible to reduce the amount of positively charged toner i.e. toner having reverse polarity with no or little reduction of the mean charge amount. There is a tendency to reduce the mean charge amount and increase the amount of positively charged toner i.e. toner having reverse polarity when the ratio of the external additive 4 relative to the total of the external additive 2 and the external additive 3 exceeds 1.0.

Therefore, it is found that the amount of reversely charged toner can be lowered compared to the toner without adding the external additive 1 as a comparative example when the ratio is 1:1 or less.

The evaluation of the image forming characteristics was made by using the full color image forming apparatus shown in FIG. 3 with the development rollers, the regulating blade, and the intermediate transfer belt as mentioned above.

Image formation was conducted in the non-contact development in the same manner as Example 3 and evaluation was also made in the same manner as Example 3. The results are shown in Table 8. It was found that the amount of fog toner and the amount of reversely transferred toner were reduced and the transfer efficiency was improved by adding the external additive 4.

TABLE 8

| | Non-Contact Development | | |
|---|---|---|---|
| | OD value | | |
| | Fog toner | Reversely transferred toner | Transfer efficiency (%) |
| Sample 5-1 | 0.085 | 0.025 | 96.5 |
| Sample 5-2 | 0.030 | 0.014 | 97.7 |

TABLE 8-continued

| | Non-Contact Development | | |
|---|---|---|---|
| | OD value | | |
| | Fog toner | Reversely transferred toner | Transfer efficiency (%) |
| Sample 5-3 | 0.010 | 0.009 | 98.6 |
| Sample 5-4 | 0.032 | 0.015 | 98.5 |
| Sample 5-5 | 0.041 | 0.016 | 98.1 |
| Sample 5-6 | 0.055 | 0.019 | 97.5 |
| Sample 5-7 | 0.063 | 0.025 | 96.6 |

EXAMPLE 6

(Production of Toner 2-M, Toner 2-C, Toner 2-Y, and Toner 2-K)

To 100 parts by weight of toner mother particles 2 in Example 2, 0.8 parts by weight of hydrophobic silica having a number-mean primary particle diameter of 12 nm and 0.6 parts by weight of hydrophobic silica having a number-mean primary particle diameter of 40 nm were added and mixed, and 0.2 parts by weight of silica modified with titania of the present invention and 0.05 parts by weight of alumina having a number-mean primary particle diameter 13 nm were then mixed, whereby a magenta toner 2-M (work function: 5.51 eV) was prepared.

A cyan toner 2-C (work function: 5.44 eV) having a mean particle diameter 6.3 μm and a degree of circularity of 0.941 was obtained by pulverization, classification, heat treatment, re-classification, and by adding the external additives at the same compounding ratio as the toner 2-M except that Phthalocyanine Blue was used as the pigment.

Further, an yellow toner 2-Y (work function: 5.57 eV) having a similar mean particle diameter was prepared by using Pigment Yellow 93 as the pigment and a black toner (work function: 5.62 eV) having a similar mean particle diameter was prepared by using Carbon Black as the pigment.

By using an elastic photoreceptor of the OPC mentioned above as the photoreceptor in a four-cycle full-color printer of an intermediate transfer medium type as shown in FIG. 3 provided with the development rollers and the regulating blades mentioned above and filling the developing units with the toners obtained in the above, respectively, image forming tests were made according to the non-contact single-component developing method.

For forming images, the peripheral velocity of the organic photoreceptor was set to 180 mm/sec. The development rollers are set to have a peripheral velocity ratio of 2 relative to the organic photoreceptor. The peripheral velocity difference between the organic photoreceptor and the transfer belt as the intermediate transfer medium is set such that the rotation of the transfer belt is faster than the organic photoreceptor by 3%.

As conditions for forming images, the dark potential of the photoreceptor was set to −600 V, the light potential of the same was set to −60 V, and the developing bias voltage was set to −200 V. The development roller and the supply roller were set to have the same potential. Under the aforementioned conditions, a character image corresponding to color original containing 5% each color was successively printed on 10000 sheets of paper. As the states of the outer surface of the photoreceptor and the periphery of the drum were observed, there was no or little fog toner and reversely transferred toner and there was no scattering toner. Therefore, it was found that the toners had suitable charging property.

A fluidity improving agent prepared by adding a double oxide fine particles comprising silica fine particles having surfaces coated with tin oxide and subjected to hydrophobic treatment by n-hexyltrimethoxysilane, a fluidity improving agent prepared by adding a double oxide fine particles comprising silica fine particles having surfaces coated with zirconium oxide and subjected to hydrophobic treatment by n-hexyltrimethxysilane, or a fluidity improving agent prepared by adding a double oxide fine particles comprising silica fine particles having surfaces coated with aluminum oxide and subjected to hydrophobic treatment by n-hexyltrimethxysilane was added in an amount of 0.2% instead of the silica-titania double oxide fine particles comprising vapor-phase-processed silica fine particles having surfaces coated with titanium oxide, thereby preparing respective toners. These toners were also evaluated in the same manner. As for either of the toners, there was no or little fog toner and reversely transferred toner and there was no scattering toner. Therefore, suitable charging property was obtained.

EXAMPLE 7

(Production of Toner 3-C, Toner 3-M, Toner 3-Y, and Toner 3-K)

To 100 parts by weight of toner mother particles 3 in Example 3, 0.8 parts by weight of hydrophobic silica having a number-mean primary particle diameter of 12 nm and 0.6 parts by weight of hydrophobic silica having a number-mean primary particle diameter of 40 nm were added and mixed, and 0.2 parts by weight of silica modified with titania of the present invention and 0.05 parts by weight of alumina having a number-mean primary particle diameter 13 nm were then added and mixed, whereby a cyan toner 3-C (work function: 5.56 eV) was prepared.

By using mother particles 3 of magenta toner produced in Example 5, a magenta toner 3-M (work function: 5.63 eV) was obtained by adding the same external additives as the toner 3-C.

Mother particles 3 of yellow toner having a mean particle diameter 6.9 μm, a degree of circularity of 0.973, and a work function of 5.59 eV and mother particles 3 of black toner having a mean particle diameter 7.0 μm, a degree of circularity of 0.974, and a work function of 5.52 eV were obtained in the same manner as the toner 3-M except that Pigment Yellow 180 and Carbon Black were used as the pigment.

Similarly, the fluidity improving agents were added to obtained toner mother particles, thereby preparing an yellow toner 3-Y (work function: 5.57 eV) and a black toner 3-K (work function: 5.5 eV).

Then, the respective development cartridges of the tandem-type full color printer shown in FIG. 4 were filled with the toner 3-C, the toner 3-M, the toner 3-Y, and the toner 3-K, respectively, and image forming tests were made according to the non-contact single-component developing method. A photoreceptor used as the photoreceptor was manufactured in the same manner as the aforementioned OPC 1 except that an aluminum tube of 30 mm in diameter was used as the conductive substrate. The development roller and the regulating blade were manufactured to have the aforementioned structures. The intermediate transfer medium was manufactured according to the production example of the transfer belt 1.

Character image corresponding to color original containing 5% each color was successively printed on 10000 sheets of paper with a developing bias applied under condition that an alternating current to be superimposed on a direct current developing bias voltage of −200 V was set to have a frequency of 2.5 kHz and a peak-peak voltage of 1400 V. As the states of the outer surface of the photoreceptor and the periphery of the drum were observed, there was no or little fog toner and reversely transferred toner and there was no scattering toner. Therefore, it was found that the toners had suitable charging property.

Moreover, a fluidity improving agent prepared by adding a double oxide fine particles comprising silica fine particles having surfaces coated with tin oxide and subjected to hydrophobic treatment by n-hexyltrimethoxysilane, a fluidity improving agent prepared by adding a double oxide fine particles comprising silica fine particles having surfaces coated with zirconium oxide and subjected to hydrophobic treatment by n-hexyltrimethxysilane, or a fluidity improving agent prepared by adding a double oxide fine particles comprising silica fine particles having surfaces coated with aluminum oxide and subjected to hydrophobic treatment by n-hexyltrimethxysilane was added in an amount of 0.2% instead of the silica-titania double oxide fine particles comprising vapor-phase-processed silica fine particles having surfaces coated with titanium oxide, thereby preparing respective toners. These toners were also evaluated in the same manner. As for either of the toners, there was no or little fog toner and reversely transferred toner and there was no scattering toner. Therefore, suitable charging property was obtained.

As mentioned above, since the toner of the present invention in which silica particles of which surfaces are modified with hydroxide or oxide of at least one metal selected from a group consisting of titanium, tin, zirconium, and aluminum are mixed in a predetermined amount relative to the amount of silica particles, the toner has a negative frictional charge site according to the silica components and a relatively positive frictional charge site. The silica components as particle substrate adhere to the surfaces of toner particles. As a result, the rate of liberation of external additives due to successive printing is reduced so that stable charging property can be ensured for a long period of time.

When silica fine particles having a small number-mean primary particle diameter and silica fine particles having a large number-mean primary particle diameter are used together with the modified silica fine particles, the embedment into mother particles can be prevented by the large-diameter silica particles, while the characteristics of the small-diameter silica particles as the fluidity improving agent are never lost.

As a result, the negative excessive charging can be prevented and the generation of positively charged toner i.e. toner having reverse polarity can be prevented. Therefore, the toner enables the stable image formation without occurrence of fog and toner scattering. Since the external additive can exhibit larger effect as fluidity improving agent, reduction in amount of used external additives is achieved, thereby preventing the fixing property of toner from being deteriorated due to addition of external additives.

What we claim is:

1. A toner produced by adding external additives to resin particles containing a coloring agent, wherein the external additives are silica particles and modified silica particles of which outer surfaces are modified with oxide or hydroxide of at least one metal selected from a group consisting of titanium, tin, zirconium, and aluminum, wherein the ratio of the modified silica particles relative to the silica particles is 0.5 to 2 parts by weight per 100 parts by weight, and wherein said silica particles and said modified silica particles are treated by a hydrophobic treatment with an agent selected from the group consisting of a silane coupling agent, a titanium coupling agent, a higher fatty, and silicone oil.

2. A toner as claimed in claim 1, wherein as the silica particles, two kinds of silica particles having different number-mean primary particle diameter are dispensed.

3. A toner as claimed in claim 1, wherein the number-mean primary particle diameter of the silica particles of one kind is in a range from 5 to 20 nm and the number-mean primary particle diameter of the silica particles of the other kind is in a range from 30 to 50 nm.

4. A toner as claimed in claim 1, wherein the toner is produced in the polymerization method.

5. A toner as claimed in claim 1, wherein the degree of circularity of the toner particles is 0.94 or more.

6. A toner as claimed in claim 1, wherein the number-mean particle diameter of the toner particles is 9 μm or less.

7. An image forming apparatus which is a full color image forming apparatus having an intermediate transfer medium for transferring an image formed on a photoreceptor onto a recording medium and of which toners are each produced by adding external additives to resin particles, wherein the external additives are silica particles and modified silica particles of which outer surfaces are modified with oxide or hydroxide of at least one metal selected from a group consisting of titanium, tin, zirconium, and aluminum, and wherein the ratio of the modified silica particles relative to the silica particles 0.5 to 2 parts by weight per 100 parts by weight.

8. An image forming apparatus as claimed in claim 7, wherein as the silica particles, two kinds of silica particles having different number-mean primary particle diameter are dispersed.

9. An image forming apparatus as claimed in claim 7, wherein the toners are negatively chargeable toners and the photoreceptor is a negatively chargeable organic photoreceptor.

10. An image forming apparatus as claimed in claim 7, wherein the intermediate transfer medium comprises a belt.

11. An image forming apparatus as claimed in claim 7, wherein the photoreceptor and the developing devices are combined in one unit as a process cartridge which is detachably installed to the body of the image forming apparatus.

12. An image forming apparatus as claimed in claim 7, wherein the peripheral velocity difference between the photoreceptor and the intermediate transfer medium is set to be in a range from 0.95 to 1.05.

* * * * *